United States Patent [19]

Hwa

[11] 4,066,398

[45] Jan. 3, 1978

[54] CORROSION INHIBITION

[75] Inventor: Chih Ming Hwa, Arlington Heights, Ill.

[73] Assignee: Chemed Corporation, Cincinnati, Ohio

[21] Appl. No.: 523,096

[22] Filed: Nov. 12, 1974

Related U.S. Application Data

[63] Continuation of Ser. No. 350,858, April 13, 1973, abandoned, which is a continuation of Ser. No. 136,592, April 22, 1971, abandoned.

[51] Int. Cl.[2] ..... C23F 11/16; C23F 11/14

[52] U.S. Cl. ..... 21/2.7 A; 21/2.5 A; 106/14; 252/8.55 E; 252/147; 252/148; 252/389 A; 252/390

[58] Field of Search ..... 252/389 A, 390, 8.55 E, 252/87, 147, 148, 181; 106/14; 210/58; 21/2.7 A, 2.5 A

[56] References Cited

U.S. PATENT DOCUMENTS

| | | | |
|---|---|---|---|
| 3,477,956 | 11/1969 | Stanford et al. | 252/389 A |
| 3,483,133 | 12/1969 | Hatch et al. | 252/389 A |
| 3,510,436 | 5/1970 | Silverstein et al. | 252/389 A |
| 3,532,639 | 10/1970 | Hatch | 252/389 A |
| 3,620,974 | 11/1971 | Stanford et al. | 252/389 A |

*Primary Examiner*—Benjamin R. Padgett
*Assistant Examiner*—Irwin Gluck
*Attorney, Agent, or Firm*—Charles L. Harness

[57] ABSTRACT

Corrosion inhibiting compositions containing hydroxyamine phosphate ester or water-soluble derivative thereof, together with water-soluble zinc salt and 1,2,3-triazole or water-soluble derivative thereof; and methods for inhibiting corrosion in aqueous systems therewith.

5 Claims, No Drawings

CORROSION INHIBITION

This is a continuation of application Ser. No. 350,858, filed Apr. 13, 1973 and now abandoned, which is a continuation of application Ser. No. 136,592, filed Apr. 22, 1971 and now abandoned.

This invention relates to corrosion inhibiting compositions and methods. In particular it relates to corrosion inhibiting compositions comprising water-soluble hydroxyamine phosphate ester or a water-soluble derivative thereof together with water-soluble zinc salt and water-soluble 1,2,3-triazole or a water-soluble derivative thereof, and to methods for inhibiting corrosion of metallic surfaces in aqueous systems by adding such compositions to the aqueous medium flowing in such systems.

In the past, chromates and inorganic polyphosphates have been used to inhibit the corrosion of metals in contact with water. The chromates are highly toxic. This is undesirable both from the viewpoint of the health of handling personnel and also because of the problem of waste disposal. Phosphates are non-toxic. However, due to the hydrolysis of polyphosphates to orthophosphates and the limited solubility of calcium orthophosphate which is likely to form, it has not been possible in many instances to maintain adequate concentrations of phosphates. This reversion process also can create sludge formation and/or scale deposition problems in the system. From a water pollution standpoint, effluent containing a sufficiently high phosphate residual may serve as a nutrient to aquatic life. For these reasons, the use of chromates and inorganic phosphates has not been entirely satisfactory.

The use of organic phosphates or phosphonates in combination with zinc and/or mercaptobenzothiazole for corrosion inhibition in aqueous systems is disclosed in Silverstein et al., U.S. Pat. No. 3,510,436 dated May 5, 1970. The use of hydroxyamine phosphate esters, per se, for scale inhibition is disclosed by Stanford et al, U.S. Pat. No. 3,477,956 dated Nov. 11, 1969 and in Oleen, U.S. Pat. No. 3,528,502 dated Sept. 15, 1970. An abstract of French Patent 1,578,650 indicates that the patent may suggest use of the hydroxyamine phosphate esters for corrosion inhibition.

It is an object of this invention to provide new and improved corrosion inhibiting compositions and methods.

In summary the corrosion inhibiting compositions of this invention consist essentially of:

1. water soluble hydroxyamine phosphate ester or a water-soluble derivative thereof;
2. sufficient water-soluble zinc compound to provide from 0.005 to 15 parts by weight of zinc ion ($Zn^{+2}$) for each part by weight of said phosphate ester, and
3. sufficient water-soluble 1,2,3-triazole or water-soluble derivative thereof to provide from 0.005 to 15 parts by weight of said azole or azole derivative for each part by weight of said phosphate ester.

In determining weight proportions in these compositions the weight of any phosphate ester derivative is calculated on the basis of the equivalent weight of the free phosphate ester from which the water-soluble derivative is derived. On the other hand, the weight of any water-soluble 1,2,3-azole derivative employed is the weight of that derivative and not the equivalent weight of the free 1,2,3-azole therein. Amounts of zinc compound are calculated as the equivalent weight of $Zn^{+2}$ ion provided thereby. All ingredients are water-soluble i.e., soluble in the aqueous system in which employed at least in the applicable concentrations used.

In summary the methods of this invention for inhibiting corrosion of metal surfaces in aqueous systems comprises maintaining in the aqueous fluid in contact with such metal surfaces:

1. from about 0.5 to about 1,000 parts per million (hereinafter "ppm") of water-soluble hydroxyamine phosphate ester or the equivalent amount of a water-soluble derivative thereof;
2. from about 0.0025 to about 15,000 ppm of zinc ($Zn^{+2}$) ion; and
3. from about 0.0025 to about 15,000 ppm of water-soluble 1,2,3-triazole or water-soluble derivative thereof.

The hydroxyamine phosphate esters used in the compositions and methods of this invention are known, per se, in the art. Their composition and methods for their preparation are fully described in the aforementioned U.S. Pat. Nos. 3,477,956 and 3,528,502, the entire disclosures of which are incorporated herein by reference. Briefly these esters are the reaction product of polyphosphoric acid or phosphorus pentoxide or a mixture of polyphosphoric acid and phosphorus pentoxide with a water-soluble hydroxyamine.

The hydroxy amine can be a relatively simple amine, such as diethanolamine or triethanolamine, or can be more complex, such as the still residues obtained in the maufacture of triethanolamine or the products obtained by oxyalkylating amines. They can be monoamines or polyamines. They can have a single hydroxy group as in aminoethylethanolamine but preferably have plurality of hydroxy groups, e.g., from 2 to 6hydroxy groups. The oxyalkylated amines are obtained by reacting an alkylene oxide containing from 2 to 6 carbon atoms in the alkylene chain; for example ethylene oxide or 1,2-propylene oxide, with an amine containing one or more reactive hydrogen atoms. The preferred hydroxy amines contain at least one terminal 2-hydroxy ethyl group ($—CH_2CH_2OH$) provided by oxyethylation. The primary hydroxyl groups thereof are more effective than the secondary hydroxyl groups which would be provided by oxypropylation $$(-CH_2\underset{\underset{CH_3}{|}}{CH}-OH)$$

However, oxypropylation may be used if the oxypropylated product is then oxyethylated to provide a terminal 2-hydroxyethyl groups. Ethylenediamine, for example can be oxyethylated with four moles of ethylene oxide per mole of diamine to produce a diamine containing four 2-hydroxyethyl groups. By using both ethylene oxide and 1,2-propylene oxide, products can be obtained with both hydroxyethyl and hydroxypropyl groups. The extent of the oxyalkylation can also be increased by increasing the number of moles of alkylene oxide and in some cases, it is desirable to use as many as 30 moles of alkylene oxide per mole of amine. In general, however, this is not necessary for the purpose of the invention. Other amines which can be oxyalkylated to provide hydroxy amines are polyalkylene polyamines containing up to 6 amino nitrogen atoms such as diethylenetriamine, triethylenetetramine, tetraethylene pentamine, pentaethylene hexamine. It is normally desirable that the hydroxy group which is to be phosphated should be separated from the nitrogen atom by at least one carbon atom and preferably by at least two carbon atoms as in the 2-hydroxyethyl group. Amines of this general structure are sometimes referred to as hydroxyalkyl amines or alkanolamines. Mixtures of hydroxy amines as well as individual amines can be employed in preparing the phosphate esters. Hence, the phosphate ester products can, and most likely do, consist of mixed phosphate esters and mixtures of phosphate esters of the hydroxy amines.

The resulant phosphate esters have an average of at least one and up to all of the hydroxyls of the amine replaced by phosphate ester groups derived from polyphosphoric acid and/or phosphorus pentoxide, said phosphate ester groups consisting essentially of one or both of a member selected from the group consisting of

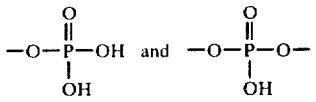

The phosphate ester may be used as is, or it may be converted to a salt by partial to complete neutralization with an alkaline substance such as, for example, potassium or sodium hydroxide, potassium or sodium carbonate, ammonia, or a basic amino compound, e.g., tetramethyl ammonium hydroxide, methylamine, ethlamine, diethylamine, triethanolamine, diethanolamine, triethyl amine, ethylene diamine, diethylene triamine, pyridine, morpholine or other amines. The amine should preferably be a water-soluble amine or at least one that does not destroy solubility in water. Other water-soluble salts may also be used; for example the zinc, cobalt, chromium, lead, tin, or nickel salts. Furthermore, the hydroxyl group(s) connected to the phosphorus atom in the phosphate ester reaction product may be esterified with a lower alkanol containing from 1 to about 4 carbon atoms to form water-soluble esters also useful in the practice of the invention.

The water-soluble zinc compound used in the practice of the invention is preferably a zinc salt such as zinc sulfate, zinc chloride, zinc nitrate, zinc acetate, or the like. Other zinc compounds which will go into solution under the conditions of use, such as zinc oxide, may also be used. The zinc may also be incorporated as the zinc salt of the phosphate ester or of the 1,2,3-azole used as the other corrosion inhibiting agents in accordance with the invention.

The weight ratio of water-soluble zinc compound providing $Zn^{+2}$ ion (as zinc) to hydroxyamine phosphate ester ranges from about 0.005:1 to about 15:1, preferably from about C.02:1 to about 2:1 and most preferably is about 1.6:1.

The 1,2,3-triazole or derivative thereof used in the practice of the invention may be 1,2,3-triazole as such, having the formula:

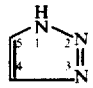

an N-alkyl substituted 1,2,3-triazole, or a substituted water-soluble 1,2,3-triazole where the substitution occurs in the 4- and/or 5- position of the 1,2,3-triazole ring. The preferred 1,2,3-triazole is benzotriazole (sometimes known as 1,2,3-benzotriazole), i.e.,:

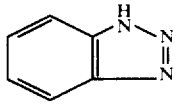

Other suitable water-soluble derivatives include, for example, 4-phenol-1,2,3-triazole; 1,2,3-tolyltriazole, 4d-methyl-1,2,3-triazole, 4-ethyl-1,2,3-triazole, 5-methyl-1,2,3-triazole, 5-ethyl-1,2,3-triazole, 5-propyl-1,2,3-triazole, and 5-butyl-1,2,3,triazole. Alkali metal or ammonium salts of 1,2,3-triazole or any of the above described derivatives thereof may also be used.

The weight ratio of the water-soluble 1,2,3-triazole or derivative to hydroxyamine phosphate ester ranges from about 0.005:1 to about 15:1, preferably from about 0.02:1 to about 2:1 and most preferably is about 1:1.

The corrosion inhibiting compositions of this invention may be used in or in conjunction with such industrial applications as water treatment, cooling water, acid pickling, radiator cooling, hydraulic fluids, antifreezes, heat transfer media, and petroleum well treatments. The compositions will provide corrosion protection for metal parts, especially ferrous metal, copper or copper alloy and aluminum or aluminum alloy parts such as the components of heat exchangers, engine jackets, and pipes in contact with an otherwise corrosive aqueous fluid.

In the methods of this invention corrosion is inhibited by maintaining in the aqueous fluid in contact with the metal surfaces to be protected an effective amount of the above-described corrosion inhibiting composition. Typically, such amounts will range from about 0.5 to about 30,000 ppm. Preferred dosage concentrations will normally range from about 5 to about 200 ppm, especially about 15ppm. As will be apparent to those skilled in the art, the methods of this invention may also be practiced by separate introduction of the three essential corrosion inhibiting ingredients into the aqueous system in the following concentrations:

| | Concentration (in ppm) | | |
|---|---|---|---|
| Ingredient | Typical Effective | Preferred Range | Especially Preferred |
| Hydroxyamine phosphate ester or derivative | about 0.5 to about 1,000 | about 3 to about 60 | about 4 |
| $Zn^{+2}$ ion | about 0.0025 to about 15,000 | about 1 to about 80 | about 7 |
| 1,2,3-triazole or derivative | about 0.0025 to about 15,000 | about 1 to about 60 | about 4 |

The invention will be further understood from the following illustrative but non-limiting examples.

EXAMPLE 1

Corrosion tests were conducted on test coupons exposed for 10 days in a simulated cooling tower which included a treatment feed system and a cooling water recirculation system. Circulating water containing calcium sulfate, 351 ppm; magnesium sulfate, 252 ppm; sodium bicarbonate, 185 ppm; and calcium chloride, 136 ppm was used. During the test, the circulating water, with or without treatment, depending upon the test underway, was fed to the closed circulating test system at a rate of 5 gallons per day, the overflow from the test system being discharged to waste.

In the closed circulating system, circulating water having a temperature of 130° Fahrenheit (54° Centigrade) and pH of 6.5 to 7 was fed at a rate of 1 gallon per minute to a coupon chamber containing test coupons for the corrosion test. Water from the coupon chamber was then passed through an arsenical-admiralty brass tube surrounded by a jacket through which a heating fluid having an initial temperature of 240° Fahrenheit (116° Centigrade) was counter-currently passed. The circulating water was then cooled to 130° Fahrenheit and recirculated through the system. Total circulating time for each test was 10 days.

Mild (SAE 1010) steel, brass (33 weight percent zinc), copper, and aluminum coupons having an average area of 26.2 square centimeters were used in the test chamber. In preparation for corrosion testing, each coupon was sandblasted and brushed to remove loosely held sand particles. After brushing, the specimens were successively immersed in running tap water, in distilled water, then dipped into isopropyl alcohol, followed by a dip into benzol. Upon removal from the benzol the specimens were air dried and stored over calcium chloride in a desiccator. Each coupon was weighed just before use. Following the corrosion test, each coupon was cleaned with inhibited acid, rinsed, dried and weighed to determine corrosion rate in mils per year (hereinafter "mpy").

The testing system was pretreated in each test by adding five times normal dosage of the treatment being tested to the circulating water during the startup of the test. Based on the treatment feed rate of 5 gallons per day, and the system volume of 2.9 gallons, pretreatment duration was about 14 hours for each corrosion test. In cooling water treatment, most methods of corrosion inhibition are based on forming a uniform impervious film that acts as a diffusion barrier to inhibit corrosion. The rate at which the protective film forms will determine largely the effectiveness of a corrosion inhibitor. Since extensive corrosion data demonstrate the effectiveness of the pretreatment principle in decreasing initial corrosion rates, pretreatment procedure was followed in the tests.

Results of the test are shown in the following Table I.

TABLE I

| | Corrosion Inhibitor Added | Corrosion Rate in Mils per Year | | | |
|---|---|---|---|---|---|
| | | Steel | Aluminum | Copper | Brass |
| Example 1 | | | | | |
| | Zinc sulfate monohydrate 18 ppm (6.5 ppm $Zn^{+2}$), benzotriazole 4 ppm, triethanolamine phosphate ester 4 ppm | 2.0 | 1.7 | 0.2 | 0.1 |
| Comparative Runs | | | | | |
| A | None (Blank) | 17.0 | 16.0 | 1.1 | 2.0 |
| B | Zinc sulfate monohydrate 18 ppm | 16.0 | 4.0 | 2.0 | 2.0 |
| C | Benzotriazole 4 ppm | 25.0 | 6.0 | 0.3 | 0.2 |
| D | Triethanolamine phosphate ester 4 ppm | 26.1 | 23.9 | 0.85 | 0.9 |
| E | 6.5 ppm $Zn^{+2}$ (as $ZnSO_4 \cdot H_2O$), 4 ppm benzotriazole | 9.0 | 2.0 | 0.2 | 0.1 |
| F | 6.5 ppm $Zn^{+2}$ (as $ZnSO_4 \cdot H_2O$), triethanolamine phosphate ester 4 ppm | 9.5 | 9.1 | 1.7 | 0.75 |
| G | Benzotriazole 4 ppm, triethanolamine phosphate ester 4 ppm | 17.4 | 12.3 | 0.8 | 1.0 |

TABLE I-continued

| | Corrosion Inhibitor Added | Corrosion Rate in Mils per Year | | | |
|---|---|---|---|---|---|
| | | Steel | Aluminum | Copper | Brass |
| H | Mercaptobenzothiazole 4 ppm, $Zn^{+2}$ 6.5 ppm (as $ZnSO_4 \cdot H_2O$), triethanolamine phosphate ester 4 ppm | 12.5 | 8.2 | 0.3 | 0.1 |

The excellent corrosion inhibition obtained with compositions and methods of this invention is vividly illustrated by comparing the results for Example 1 with comparative runs A through D. The synergistic interactivity of the essential components of the composition of Example 1 is demonstrated by the data for that Example as compared to Runs B through G. As demonstrated by Run H, the substitution of a benzothiazole, specifically mercaptobenzothiazole

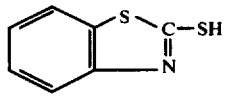

for the 1,2,3-triazole used in the practice of this invention (as might be suggested by the aforementioned U.S. Patent 3,510,436) does not provide effective universal protection.

EXAMPLES 2 - 21

The following compositions according to this invention show similar unexpected corrosion inhibitions when tested by the procedure described in Example 1.

| | Percent by Weight |
|---|---|
| Example 2: | |
| Zinc sulfate monohydrate | 68.6 |
| Benzotriazole | 15.7 |
| Diethanolamine phosphate ester | 15.7 |
| Example 3: | |
| Zinc sulfate monohydrate | 67 |
| 1,2,3-tolyltriazole | 16 |
| Triethanolamine phosphate ester | 17 |
| Example 4: | |
| Zinc chloride | 62.6 |
| Benzotriazole | 18.7 |
| Tri(hydroxyethyl oxyethylene) amine phosphate ester | 18.7 |
| Example 5: | |
| Zinc nitrate hexahydrate | 78.4 |
| 4-Methyl-1,2,3-triazole | 10.8 |
| Triethanolamine phosphate ester | 10.8 |
| Example 6: | |
| Zinc sulfate monohydrate | 97.59 |
| 4-phenyl-1,2,3-triazole | 0.01 |
| Di(hydroxyethyl oxyethylene) amine phosphate ester | 2.40 |
| Example 7: | |
| Zinc sulfate monohydrate | 84.3 |
| 5-butyl-1,2,3-triazole | 0.3 |
| Di(hydroxyethyl oxypropylene) amine phosphate ester | 15.4 |
| Example 8: | |
| Zinc sulfate monohydrate | 1.8 |
| Benzotriazole | 65.4 |
| Sodium salt of triethanolamine phosphate ester | 32.8 |
| Example 9: | |
| Zinc chloride | 5.7 |
| Benzotriazole | 3.6 |
| Tri(hydroxyethyl oxypropylene) amine phosphate ester | 90.7 |
| Example 10: | |
| Zinc chloride | 6.5 |
| 4-ethyl-1,2,3-triazole | 4.0 |
| Triethanolamine phosphate ester | 89.5 |

-continued

| | Percent by Weight |
|---|---|
| Example 11: | |
| Zinc sulfate monohydrate | 7.3 |
| Benzotriazole | 3.6 |
| Triethanolamine phosphate ester | 89.1 |
| Example 12: | |
| Zinc sulfate monohydrate | 0.1 |
| Benzotriazole | 93.6 |
| N,N,N',N'-tetrahydroxyethyl ethylenediamine phosphate ester | 6.3 |
| Example 13: | |
| Zinc nitrate hexahydrate | 11.6 |
| 5-propyl-1,2,3-triazole | 3.4 |
| pentahydroxyethyl diethylenetriamine phosphate ester | 85.0 |
| Example 14: | |
| Zinc nitrate hexahydrate | 12.0 |
| Benzotriazole | 4.0 |
| Triethanolamine phosphate ester | 84.0 |
| Example 15: | |
| Zinc sulfate monohydrate | 8.0 |
| 1,2,3-tolyltriazole | 4.0 |
| Potassium salt of diethanolamine phosphate ester | 88.0 |
| Example 16: | |
| Zinc sulfate monhydrate | 70.0 |
| Benzotriazole | 16.0 |
| N,N,N',N'-tetrahydroxyethyl ethylenediamine phosphate ester | 14.0 |
| Example 17: | |
| Zinc sulfate monhydrate | 63.0 |
| 4-methyl-1,2,3-triazole | 15.0 |
| Pentahydroxyethyl diethylenetriamine phosphate ester | 22.0 |
| Example 18: | |
| Zinc nitrate hexahydrate | 72.0 |
| 1,2,3-tolyltriazole | 9.0 |
| Triethanolamine phosphate ester | 19.0 |
| Example 19: | |
| Zinc sulfate monohydrate | 66.0 |
| Benzotriazole | 13.0 |
| Tri(hydroxyethyl oxypropylene) amine phosphate ester | 21.0 |
| Example 20: | |
| Zinc sulfate monohydrate | 6.0 |
| 5-ethyl-1,2,3-triazole | 4.0 |
| Di(hydroxyethyl oxyethylene) amine phosphate ester | 90.0 |
| Example 21: | |

-continued

| | Percent by Weight |
|---|---|
| Zinc chloride | 54.0 |
| Benzotriazole | 20.0 |
| Triethanolamine phosphate ester | 26.0 |

What is claimed is:

1. A method for inhibiting corrosion of a metal surface consisting of a member of the group consisting of steel and aluminum, which consists of maintaining in an aqueous fluid in contact with said surface a corrosion inhibiting amount of a corrosion inhibiting composition consisting essentially of:

a. water-soluble hydroxyamine phosphate ester, said amine phosphate ester comprising the reaction product of polyphosphoric acid, phosphorus pentoxide or a mixture of polyphosphoric acid and phosphorus pentoxide with a water-soluble hydroxyamine;

b. sufficient water-soluble zinc compound to provide from 0.005 to 15 parts by weight of zinc ion for each part by weight of said phosphate ester; and c. sufficient water-soluble 1,2,3-triazole to provide from 0.005 to 15 parts by weight of said azole or azole derivative for each part by weight of said phosphate ester.

2. The method as defined in claim 1 in which said hydroxyamine is triethanolamine.

3. The method as defined in claim 1 in which said zinc compound is a water-soluble zinc salt.

4. The method as defined in claim 1 wherein said azole is benzotriazole.

5. The method as defined in claim 1 which consists essentially of maintaining in the aqueous fluid in contact with such metal surface a. at least about 0.5 parts per million of water-soluble hydroxyamine phosphate ester;

b. at least about 0.0025 parts per million of zinc ($Zn^{+2}$) ion; and c. at least about 0.0025 parts per million of water-soluble 1,2,3-triazole.

* * * * *